United States Patent [19]

Wheeler et al.

[11] Patent Number: 4,493,203

[45] Date of Patent: Jan. 15, 1985

[54] RESILIENT INTERNAL MANDREL

[75] Inventors: Lionel H. Wheeler, Houston, Tex.; Robert G. Goekler, Owasso; Daniel G. Luddeke, Tulsa, both of Okla.

[73] Assignee: Crutcher Resources Corporation, Houston, Tex.

[21] Appl. No.: 461,172

[22] Filed: Jan. 26, 1983

[51] Int. Cl.[3] ..... B21D 9/01

[52] U.S. Cl. ..... 72/369; 72/466

[58] Field of Search ..... 72/58, 465, 466, 369

[56] References Cited

U.S. PATENT DOCUMENTS

| | | | |
|---|---|---|---|
| 2,971,556 | 2/1961 | Armstrong et al. | 72/466 |
| 3,180,130 | 4/1965 | Avera | 72/465 |
| 3,279,237 | 10/1966 | Rader | 72/466 |
| 3,580,044 | 5/1971 | DeVoss et al. | 72/466 |
| 4,006,619 | 2/1977 | Anderson | 72/58 |

FOREIGN PATENT DOCUMENTS

| | | | |
|---|---|---|---|
| 585898 | 12/1977 | U.S.S.R. | 72/466 |

*Primary Examiner*—Lowell A. Larson

*Attorney, Agent, or Firm*—Richards, Harris & Medlock

[57] ABSTRACT

An internal mandrel (10) is disclosed which is used for supporting the inner wall (30) of a pipe (12) during bending. The internal mandrel includes a urethane plug (31) which is compressed between the piston (60) of a hydraulic cylinder (56) and an end plate (36). This expands the urethane radially outward into contact with the inner wall (30) of the pipe to support the pipe during bending. Resilient steel strips (88) can be mounted on the exterior surface of the urethane plug (31) at the inside bend of the pipe to increase the effective wall thickness of the pipe at the inner bend to reduce the likelihood of deformation during bending. In a second embodiment, internal mandrel (200) includes an annular urethane plug (204) positioned between a resilient cylinder (202) and the inner wall of the pipe (12).

24 Claims, 12 Drawing Figures

RESILIENT INTERNAL MANDREL

TECHNICAL FIELD

This invention relates to the bending of pipe, and in particular to the support of the inner wall of the pipe during bending to maintain the pipe cross section.

BACKGROUND ART

In bending pipe, and particularly larger diameter pipe from 6 inch diameter and larger, it is often beneficial or necessary to support the inner wall of the pipe near the bend. If unsupported, the bending forces exerted on the exterior of the pipe can cause severe deformation of the cross section of the pipe, reducing its strength and carrying capacity. It is particularly helpful to support the inner wall of the pipe in the portion which becomes the inside of the bend to prevent wrinkling of the pipe in this area.

In the past, large and complex internal mandrel devices have been employed. Such devices include the devices disclosed and illustrated in U.S. Pat. Nos. 3,834,210 and 3,851,519. These prior devices are typically provided with a plurality of metal shoes or strips which are expanded into contact with the inner walls of the pipe by a plurality of hydraulic cylinders. While these devices are effective, the complexity of the devices increase cost and maintenance requirements.

A need exists for an internal mandrel overcoming the disadvantages of the prior devices. The improved mandrel should have a minimum of operating components and operate with a minimum number of controls. The improved mandrel should be relatively lightweight and easy to move through the interior of the pipe prior to and after bending.

SUMMARY OF THE INVENTION

In accordance with one aspect of the present invention, an internal mandrel is provided for use with a pipe bender to bend the pipe. The internal mandrel includes a first structure and a deformable resilient material positioned on one side of the first structure, said first structure and deformable resilient material being positioned within the pipe. Structure is provided for deforming the deformable resilient material against the first structure to expand the deformable resilient material to support the internal walls of the pipe proximate the bend.

In accordance with another aspect of the present invention, an internal mandrel is provided for use with a pipe bender to bend the pipe which includes first and second end structures and a connection structure for limiting the separation of the first and second end structures. A first movable structure is positioned proximate the second end structure and between the end structures for movement therebetween. A deformable resilient material is positioned between the first movable structure and the first end structure, the end structures, connection structure, movable structure and deformable resilient material being movable within the pipe for positioning near the bend. Moving means act between the second end structure and the first movable structure for moving the first movable structure toward the first end structure to expand the deformable resilient material therebetween into contact with the internal walls of the pipe to support the pipe during bending. Subsequent to bending, the deformation in the deformable resilient material is released, allowing free movement of the mandrel within the pipe.

In accordance with yet another aspect of the present invention, a method for internally supporting pipe during bending is provided. The method includes the step of positioning a deformable resilient material within the pipe proximate the bend. The method further includes the step of deforming the material along the length of the pipe so that the material expands into contact with the internal wall of the pipe to support the pipe during bending.

BRIEF DESCRIPTION OF THE DRAWINGS

A more complete understanding of the invention and its advantages will be apparent from the foregoing Detailed Description when taken in conjunction with the accompanying Drawings in which.

DETAILED DESCRIPTION

Figure 1:
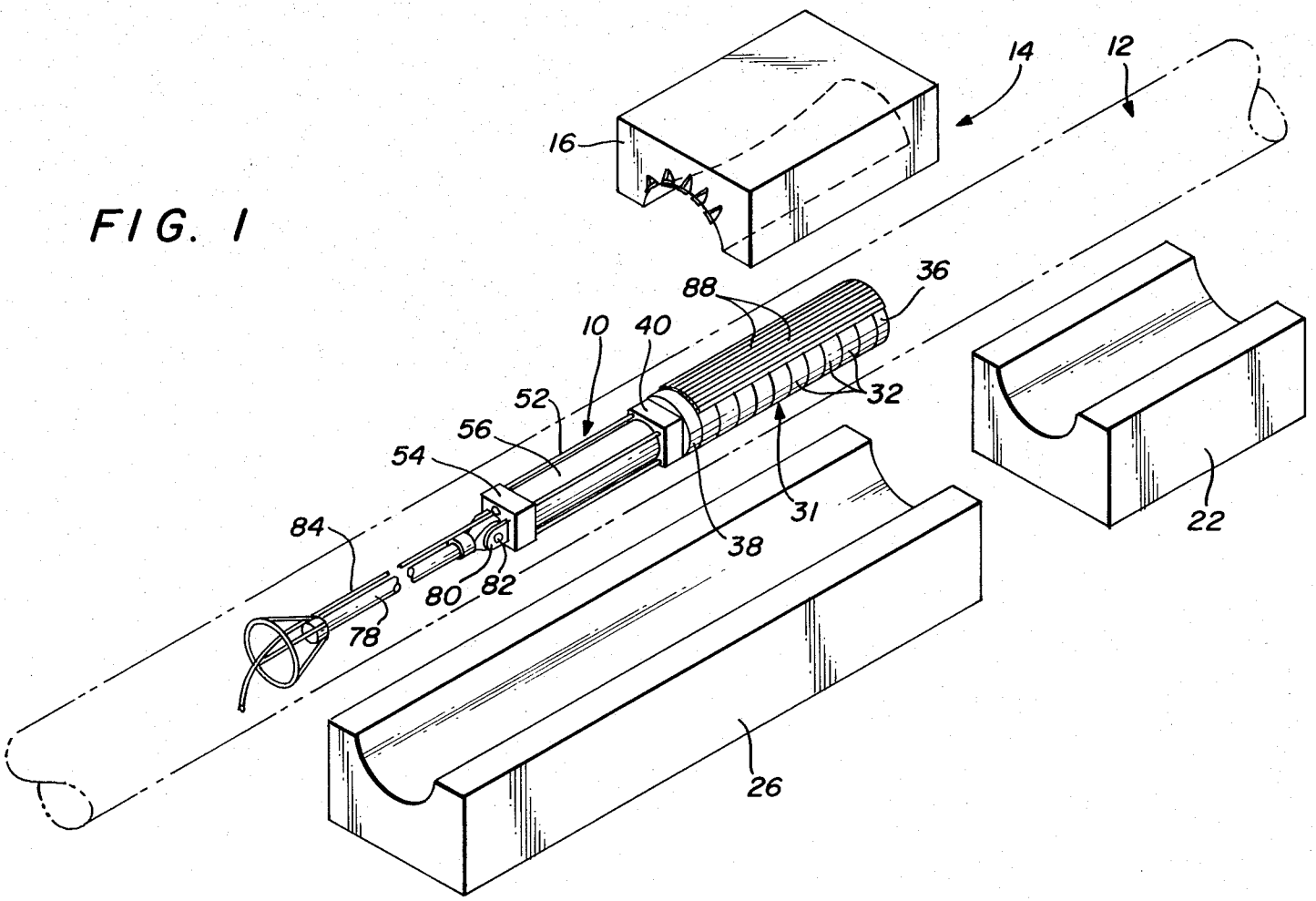
FIG. 1 is a perspective view of an internal mandrel forming a first embodiment of the present invention.

Referring now to the Drawings, wherein like reference numerals designate like or corresponding parts through several views, there is shown in FIGS. 1–4 an internal mandrel 10 forming a first embodiment of the present invention. The internal mandrel 10 is designed for use in bending pipe 12 in a pipe bending machine 14. One such pipe bending machine is described and illustrated in U.S. Pat. No. 3,834,210, issued Sept. 10, 1974, which disclosure is hereby incorporated by reference.

As seen in FIGS. 4*a–d*, the pipe 12 to be bent is moved into the machine 14 and positioned under the bending die 16 at the point where the bend is to commence. A pin-up cylinder 18 forces a wedge 20 underneath a pin-up shoe 22. The pin-up shoe 22 moves upwardly to engage the pipe 12. An inboard cylinder 24 acts between the frame of the machine 14 and a stiff back 26. The inboard cylinder 24 urges the stiff back up to push the pipe against the bending die 16. With the bending die acting as a fulcrum, the outboard cylinder 28 pushes the outer end of the stiff back up, bending the pipe to the radius and length of curve determined by the bending die configuration in contact with the pipe.

Typically, the pipe 12 is moved through the machine 14 toward the pin-up shoe 22 in small increments with the bending operation repeated until a final desired pipe curvature is achieved. The pipe 12 is always moved toward the pin-up shoe 22 during bending to keep a straight portion of the pipe in the stiff back 26.

The internal mandrel 10 is typically inserted within pipe 12 from the stiff back end and is positioned proximate the bend. In a manner described hereinafter, the internal mandrel supports the internal wall 30 of the pipe proximate the bend about the entire 360° circumference of the interior wall for a predetermined length of the pipe. As noted previously, the use of the internal mandrel assists the maintenance of a circular internal cross section in the bent pipe to insure strength and capacity. Resilient deformable plug 31, formed of individual discs 32 made of urethane 34, is deformed from both ends. While urethane is the preferred material for plug 31, any other suitable material can be used. The plug 31 expands into contact with the internal wall 30 to support the wall during bending.

Figure 2:
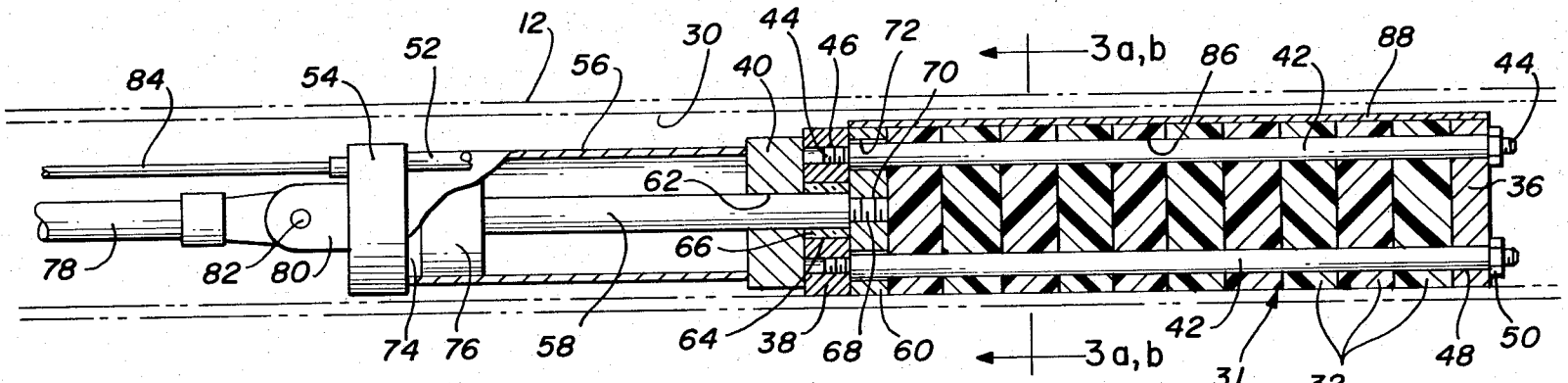
FIG. 2 is a vertical cross-sectional view of the internal mandrel forming the first embodiment.

The construction of the internal mandrel 10 is best illustrated in FIGS. 1 and 2. A first circular end plate 36 is used which has an exterior diameter slightly less than the internal diameter of the pipe to be bent so that the end plate 36 can move freely through the pipe while maintaining a minimal gap between the outer periphery of the end plate and internal wall 30. A similar, second end plate 38 is also provided. The end plate 38 is rigidly secured to a cylinder adapter plate 40. The end plates 36 and 38 and adapter plate 40 are supported and interconnected by four tie rods 42. The tie rods have threaded ends 44. Threaded holes 46 are provided in the end plate 38 for receiving one end of the tie rods. Holes 48 are formed in end plate 36 through which the tie rods extend. Nuts 50 are threaded onto the ends 44 of the tie rods passing through the end plate 36 to limit the motion of end plate 36, although end plate 36 can slide along tie rods 42 between end plate 38 and nuts 50.

Four hydraulic cylinder tie rods 52 extend from the cylinder adapter plate 40 to a hydraulic cylinder rear plate 54. The plates 40 and 54 support a hydraulic cylinder 56 therebetween having a piston rod 58 and an external piston 60. The piston rod 58 extends through a hole 62 in the cylinder adapter plate 40 and a hole 64 in the end plate 38. The hole 64 mounts a bushing 66 to support the piston rod 58. The end of piston 60 has a threaded portion 68 to be received in a threaded hole 70 in the piston 60. The piston 60 includes apertures 72 having a diameter exceeding the diameter of tie rods 42 distributed on the piston which permit free movement of the piston 60 along the tie rods 42. When hydraulic fluid enters chamber 74 of the hydraulic cylinder 56, the fluid acts against the internal piston 76 to move the piston 60 toward the end plate 36 and away from the end plate 38.

In order to insert the internal mandrel 10 within the pipe 12, a control or reach rod 78 is pivotally secured to the hydraulic cylinder rear plate 54 by a clevis 80 and pin 82. A hydraulic line 84 extends from the hydraulic cylinder 56 along the control rod 78 exterior of the pipe for supplying the cylinder with pressurized hyraulic fluid. The internal mandrel 10 can be mounted on wheels, permitting the mandrel to be rolled into the pipe, or can be self powered by hydraulic or compressed air motors to move through the pipe.

The resilient deformable discs 32 forming plug 31 are positioned between the piston 60 and end plate 36. The discs 32 have apertures 86 for passage of the tie rods 42. Each disc 32 is separate from the others and is stacked along the tie rods 42 to form whatever length of plug 31 is needed.

A number of resilient flexible strips 88 are positioned along the length of the mandrel between the end plates 36 and 38. The strips can be formed of spring steel and secured either to the end plates, the discs 32, or both. For example, the strips 88 can be welded or tied at their ends to end plates 36 and 38. Strips 88 can also be bonded to discs 32, either by a special bonding compound or by the urethane itself. The strips are positioned in a closely spaced arrangement about a portion of the circumference of the plug 31 near the inner portion 73 of the bend in pipe 12.

In operation, the internal mandrel 10 is initially moved into the pipe to position the discs 32 at the point of bending. Hydraulic fluid under pressure is permitted to flow through hydraulic line 84 and into the chamber 74. As the pressurized hydraulic fluid enters the chamber 74, the internal piston 76 is moved toward the cylinder adapter plate 40, which causes the piston 60 to move away from the end plate 38 and toward the end plate 36.

Figure 3B:
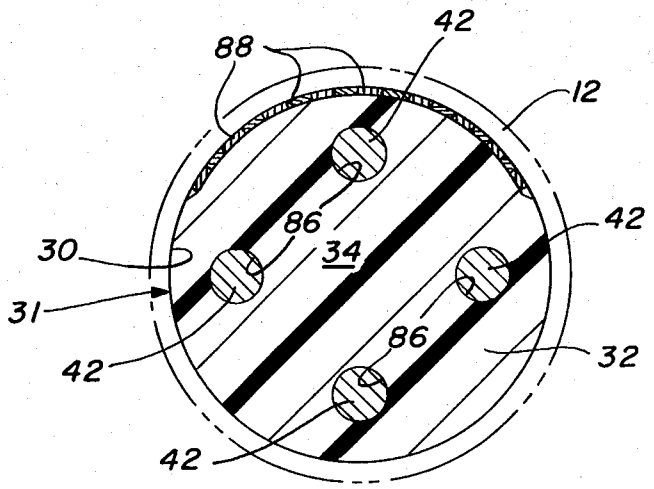
FIGS. 3*a* and 3*b* illustrate a cross section of the internal mandrel and pipe perpendicular the length of the pipe in the relaxed and deformed positions, respectively.
Figure 3A:
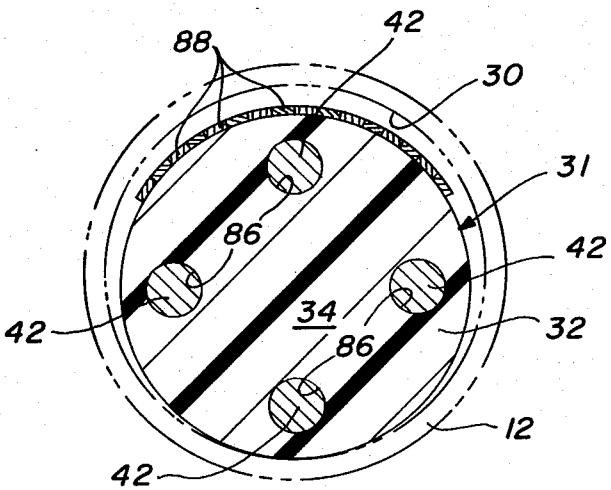
Figure 4A:
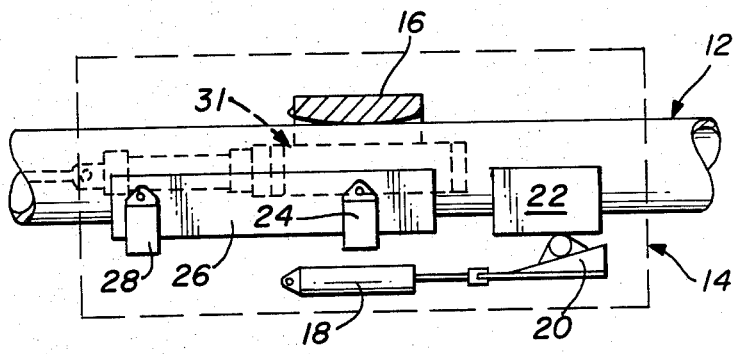
FIGS. 4*a* and 4*b* illustrate a side view of the bending machine and cross section of the internal mandrel and pipe taken along the length of the pipe, respectively, illustrating the relative positions of the mandrel and pipe prior to bending.
Figure 4B:
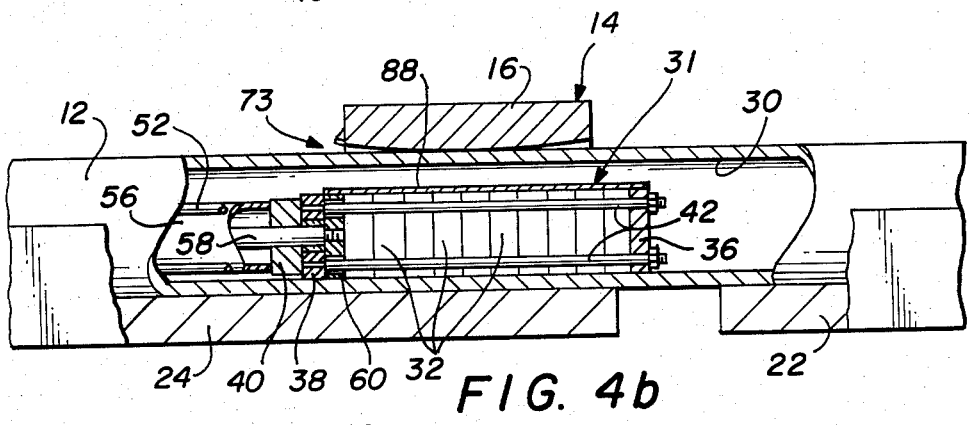
Figure 4C:
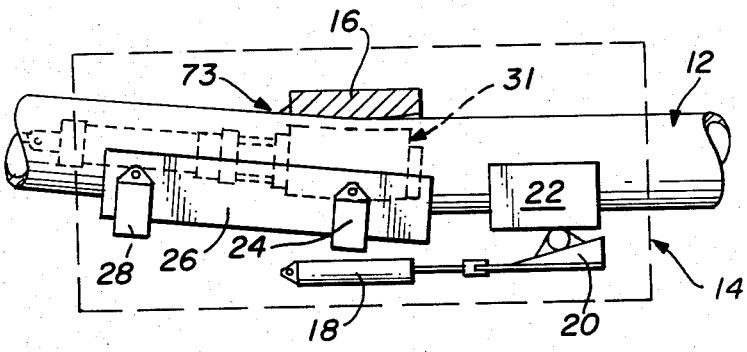
FIGS. 4*c* and 4*d* illustrate a side view of the bending machine and a cross section of the internal mandrel and pipe taken along the length of the pipe, respectively, illustrating the relative positions of the mandrel and pipe subsequent to bending.
Figure 4D:
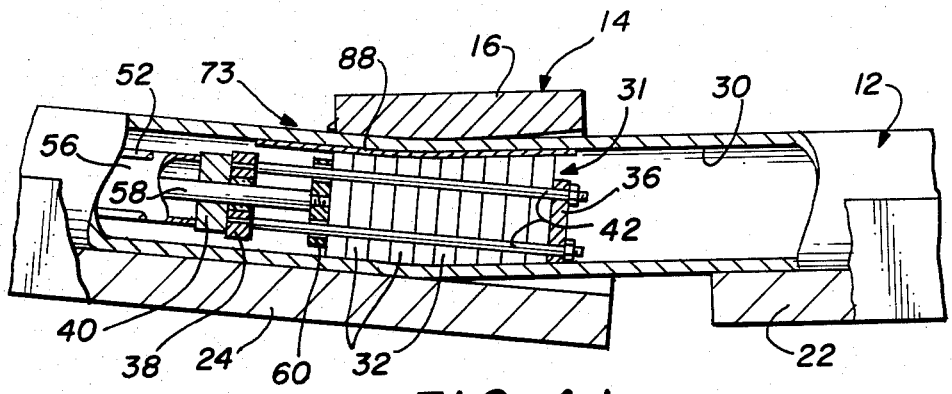

As the piston 60 moves toward end plate 36, the discs 32 are deformed between the piston 60 and end plate 36. As the discs 32 are deformed in the linear direction along the central axis of the pipe, they expand radially into contact with the internal wall 30 of the pipe 12 as seen in FIGS. 3*b*, 4*c* and 4*d*. Sufficient hydraulic force is provided by the fluid in chamber 74 to expand the discs 32 to support the internal wall of the pipe 12 during bending. The strips 88, compressed between the discs 32 and the internal wall 30 at the inner portion of the bend, conform to the shape of the internal wall and act to increase the effective thickness of the pipe 12 at the inner portion of the bend, reducing the incidence of wrinkling and other deformation.

As can be seen in FIGS. 4*c* and 4*d*, there is sufficient freedom of motion in the discs 32 and strips 88 relative to the remainder of mandrel 10 to permit the discs 32 and strips 88 to conform to the bending curvature in the pipe while the remainder of the internal mandrel 10 remains centered along a linear axis. Upon release of the hydraulic pressure from chamber 74, the resiliency in the discs 32 forces the piston 60 toward the end plate 38 as the discs 32 relax to their predeformation state. This resiliency moves the discs 32 out of contact with the internal wall 30 of the pipe 12 and permits the internal mandrel 10 to be readily removed from the pipe or repositioned for further bending. The natural resiliency of the urethane automatically returns the mandrel to its pre-bending configuration upon removal of external forces, eliminating the need for any spring return mechanism as required in prior devices. In addition, the mandrel 10 is operated by use of a single hydraulic control controlling inlet and outlet of fluid from the chamber 74.

If desired, the strips 88 can extend about the entire periphery of the discs 32, or to any extent desired. The individual strips 88 can be substituted for by a half cylindrical section, slotted to achieve a range of motion similar to individual strips. The discs 32 can also be substituted for by a single cylinder extending between the piston 60 and end plate 36.

In operation, it is anticipated that the stroke of piston 60 will be approximately 4 to 4½ inches for a 6 inch diameter pipe, 6 inches for an 8 inch diameter pipe and 8 inches for a 10 inch diameter pipe. The natural resiliency of the urethane in discs 32 also makes the general configuration of mandrel 10 useful as an energy accumulator. If surplus energy exists, it can be stored in mandrel 10 by compression of the urethane, and the energy can be recovered at a later time by relaxation of the discs.

FIGS. 5 and 6 illustrate an internal mandrel 200 forming a second embodiment of the present invention. A number of elements of the mandrel 200 are identical in form and function to those described previously with respect to internal mandrel 10. These portions have been identified in FIGS. 5 and 6 by identical reference numerals and reference is directed hereinabove for a description of their design and function.

A resilient flexible cylinder 202 is secured between the end plates 36 and 38. The cylinder 202 can, for example, be formed of a spring steel. An annular resilient deformable plug 204 surrounds the exterior of the cylinder 202. Again, the plug 204 is preferably formed of urethane. A piston 206 having an annular configuration is mounted at the end of rods 208 passing through holes 210 in the end plate 38. Rods 208, in turn, are secured to a back piston 212 secured to the piston rod 58. Piston 206 is therefore mounted for free motion along the exterior of the cylinder 202 and for contact with the end of the plug 204.

Figure 5A:
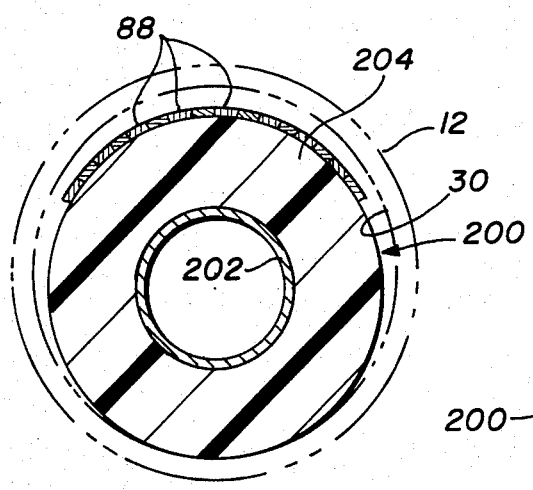
FIGS. 5*a* and 5*b* illustrate a cross section of an internal mandrel forming a second embodiment of the present invention and pipe perpendicular the length of the pipe in the relaxed and deformed positions, respectively.
Figure 5B:
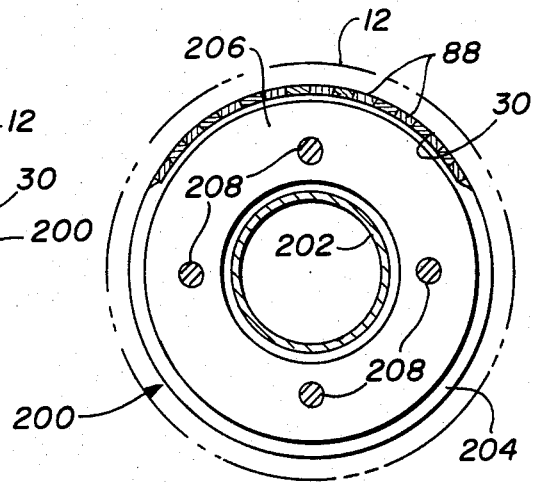
Figure 6A:
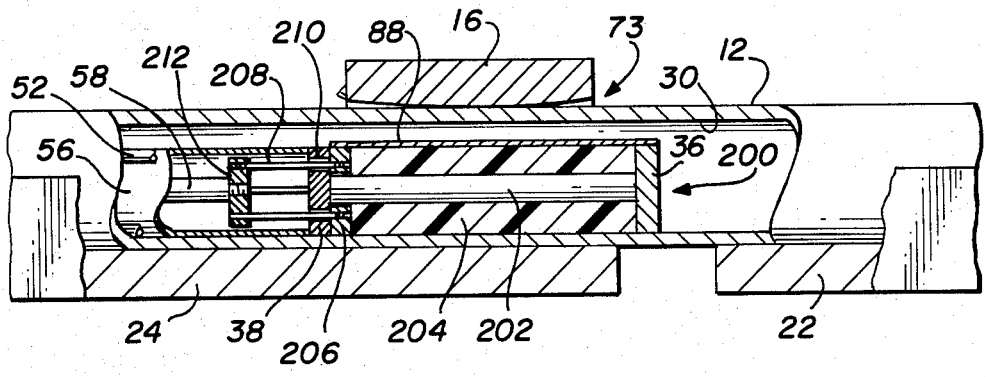
FIGS. 6*a* and 6*b* illustrate a cross section of the relative positions of the internal mandrel forming the second embodiment and pipe prior to and subsequent to bending, respectively.
Figure 6B:
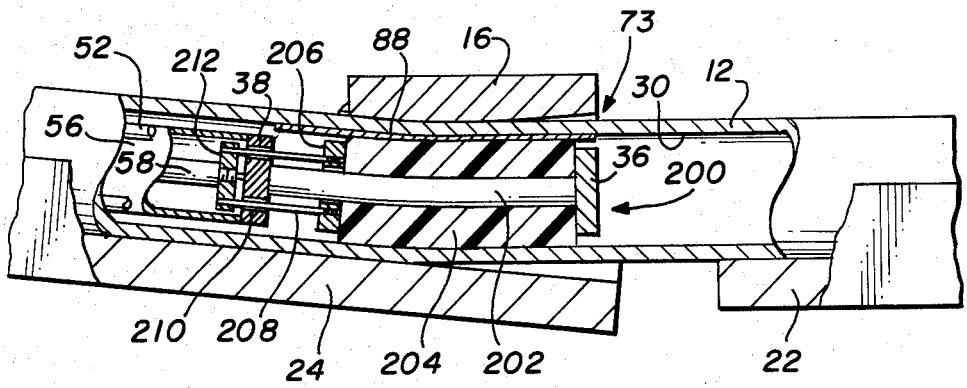

The internal mandrel 200 is also moved into the pipe 12 prior to bending with the plug 204 positioned at the point of bending. FIGS. 5*a* and 6*a* illustrate the configuration of the mandrel prior to bending with the plug 204 in its relaxed state, subject to no external forces. As pressurized hydraulic fluid enters the chamber 74, the piston rod 58 and piston 206 move toward the end plate 36. The piston 206 deforms the plug 204 between the piston 206 and end plate 36, expanding the plug 204 against the outer surface of cylinder 202 and against the internal wall 30 of the pipe 12 to support the pipe during bending. FIGS. 5*b* and 6*b* illustrate the configuration of the mandrel during and immediately subsequent to bending. As can be seen in FIG. 6*b*, the resilient cylinder 202 conforms to the shape of the bend in pipe 12 as does the plug 204. The use of cylinder 202 permits a reduction in the quantity of urethane or similar material used in the plug 204. It further permits the use of a single piece plug 204. These advantages permit the internal mandrel 200 to be particularly effective on large pipes having diameters greater than 20 inches.

While several embodiments of the present invention have been described in detail herein and shown in the accompanying Drawings, it will be evident that various further modifications or substitutions of parts and elements are possible without departing from the scope of the invention.

We claim:

1. An internal mandrel for use with a pipe bender to bend a pipe, comprising:

a first end structure;

a deformable resilient material having a first face and a second face positioned on one side of the first end structure with the first face abutting the first end structure;

deformation means having a first portion and a second portion, said second portion abutting the second face of the deformable resilient material, said deformation means for moving said second portion relative to said first portion; and connector means forming a connector that is rigid in a direction parallel the length of the pipe, said rigid connector for extending between the first end structure and the first portion of the deformation means for supporting the first end structure and deformation means so that when the second portion moves relative to the first portion toward the second face of the deformable resilient material, the deformable resilient material is deformed between the second portion of the deformation means and the first end structure to expand the deformable resilient material to support the internal walls of the pipe proximate the bend.

2. The internal mandrel of claim 1 wherein said deformable resilient material resiliently returns to its relaxed shape after deformation for movement of the mandrel within the pipe.

3. The internal mandrel of claim 1 wherein said deformable resilient material is urethane.

4. The internal mandrel of claim 1 further comprising flexible material positioned between the deformable resilient material and the internal wall of the pipe at the inside of the bend to increase the effective thickness of the pipe at the inside of the bend.

5. The internal mandrel of claim 1 wherein said deformation means for deforming said deformable resilient material includes a hydraulic cylinder assembly.

6. The internal mandrel of claim 1 wherein said first portion of said deformation means includes a second end structure, the deformable resilient material being positioned between the first and second end structures and said connector includes a connecting structure secured between said first and second end structures and passing through said deformable resilient material.

7. The internal mandrel of claim 6 wherein said connecting structure comprises at least one resilient member, said resilient member bending with the pipeand deformable material as the pipe is bent.

8. An internal mandrel for use with a pipe bender to bend the pipe, comprising:

a first end structure;

a deformable resilient material positioned on one side of the first end structure, said first end structure and deformable resilient material being positioned within the pipe;

means for deforming the deformable resilient material against the first end structure to expand the deformable resilient material to support the internal walls of the pipe proximate the bend;

a second end structure, the deformable resilient material being positioned between the first and second end structures;

a connecting structure secured between said first and second end structures and passing through said compressible material; and said connecting structure comprising at least one rigid member for maintaining the first and second end structures in a rigid, spaced apart relation.

9. An internal mandrel for use with a pipe bender to bend a pipe, comprising:

a first end structure;

a second end structure;

connection means for limiting the distance separating said first and second end structures;

a first movable structure positioned proximate said second end structure and between said first and second end structures for movement therebetween;

a deformable resilient material positioned between said first movable structure and said first end structure, said end structures, connection means, movable structure and deformable resilient material being insertable within the pipe proximate the bend; and means acting between said second end structure and said movable structure for moving said first movable structure towards the first end structure to expand the deformable resilient material therebetween into contact with the internal wall of the pipe to support the pipe during bending, said means for moving further permittng said first movable structure to move away from said first end structure subsequent to bending, the resiliency of the deformable resilient material causing the material to move to a relaxed position and permit movement of the internal mandrel within the pipe subsequent to bending.

10. The internal mandrel of claim 9 wherein said deformable resilient material is urethane.

11. The internal mandrel of claim 9 wherein said deformable resilient material is formed of a plurality of separate disc shaped members formed of deformable resilient material.

12. The internal mandrel of claim 9 further comprising a resilient flexible material positioned between the deformable resilient material and the internal wall of the pipe at the inner bend of the pipe, said resilient flexible material being compressed between the inner wall and deformable resilient material to increase the effective thickness of the pipe to resist deformation during bending.

13. The internal mandrel of claim 9 wherein said means for moving includes a hydraulic cylinder assembly.

14. The internal mandrel of claim 9 wherein said connection means comprises a plurality of rigid members.

15. The internal mandrel of claim 9 wherein said connection means comprises a resilient flexible cylinder having a central longitudinal axis generally parallel the central longitudinal axis of the pipe, said deformable resilient material being formed in a cylindrical shape and positioned between the outer surface of the resilient flexible cylinder and the inner wall of the pipe, said deformable resilient material and resilient flexible cylinder bending with the pipe.

16. An internal mandrel for use with a pipe bender to bend a pipe, comprising:

a first end structure sized for passage into the pipe;

a second end structure sized for passage into the pipe;

connecting structure secured to said first and second end structures to limit the separation of said end structures;

a piston positioned between the end structures and movable relative thereto;

a urethane plug positioned between said piston and said first end structure;

means for moving said piston towards said first end structure to deform the urethane plug between the piston and first end structure, expanding the urethane plug radially outward to support the internal wall for the pipe during bending, the resiliency of the urethane plug moving said piston away from said first end structure after bending and permitting the urethane plug to relax radially inward for free movement of the internal mandrel within the pipe.

17. The internal mandrel of claim 16 further comprising a plurality of resilient metal strips extending parallel the central axis of the pipe and spaced about a portion of the outer surface of the urethane plug for conforming to the shape of the internal wall of the pipe at the inside of the bend of the pipe as the urethane plug expands to increase the effective wall thickness of the pipe during bending.

18. The internal mandrel of claim 16 wherein said means for moving comprises a hydraulic cylinder assembly.

19. The internal mandrel of claim 16 wherein said connecting structure comprises a plurality of rigid rods interconnecting the first and second end structures, said urethane plug being formed of a plurality of urethane discs in abutting relationship.

20. The internal mandrel of claim 16 wherein said connecting structure comprises a resilient metal cylinder, said urethane plug comprising an annular urethane member positioned between the outer surface of the resilient cylinder and the inner wall of the pipe.

21. A method for internally supporting pipe during bending including the steps of:

positioning a deformable resilient material within the pipe proximate the bend;

positioning a first end structure at one end of the deformable resilient material;

positioning a deformation means at the opposite end of the deformable resilient material, said deformation means having a first portion and a second portion, said deformation means for moving the second portion relative to the first portion;

supporting the first end structure and the first portion of the deformation means with a connector that is rigid along a direction parallel the length of the pipe; and deforming the deformable resilient material between the second portion of the deformation means and the first end structure by moving the second portion relative to the first portion towards the deformable resilient material so that the material expands radially outward into contact with the internal wall of the pipe to support the pipe during bending.

22. The method of claim 21 further comprising the step of positioning flexible members between the deformable material and the internal wall of the pipe at the inside of the bend in the pipe to increase the effective wall thickness of the pipe.

23. The method of claim 21 wherein said deformable material comprises urethane.

24. The method of claim 22 wherein said flexible members comprise spring steel strips extending longitudinally parallel the central axis of the pipe.

* * * * *

UNITED STATES PATENT AND TRADEMARK OFFICE

CERTIFICATE OF CORRECTION

PATENT NO. : 4,493,203

DATED : January 15, 1985

INVENTOR(S) : Lionel H. Wheeler, Robert G. Goekler and Daniel G. Luddeke

It is certified that error appears in the above-identified patent and that said Letters Patent is hereby corrected as shown below:

Column 3, line 62, change "hyraulic" to --hydraulic--.

Column 7, line 10, change "permittng" to --permitting--.

Signed and Sealed this

*Twenty-fifth* Day of *June 1985*

[SEAL]

*Attest:*

DONALD J. QUIGG

*Attesting Officer* *Acting Commissioner of Patents and Trademarks*